US006146804A

United States Patent [19]

Miyamoto et al.

[11] Patent Number: 6,146,804

[45] Date of Patent: Nov. 14, 2000

[54] ELECTROPHOTOGRAPHIC LIQUID DEVELOPER AND IMAGE FORMING APPARATUS

[75] Inventors: Hidetoshi Miyamoto, Takatsuki; Toshimitsu Fujiwara, Osaka; Shuji Iino, Otsu; Masaharu Kanazawa, Suita; Seishi Ojima, Tatatsuki, all of Japan

[73] Assignee: Minolta Co., Ltd., Osaka, Japan

[21] Appl. No.: 09/471,266

[22] Filed: Dec. 23, 1999

Related U.S. Application Data

[62] Division of application No. 09/053,697, Apr. 2, 1998, abandoned.

[30] Foreign Application Priority Data

| | | | |
|---|---|---|---|
| Apr. 3, 1997 | [JP] | Japan | 9-84791 |
| Apr. 3, 1997 | [JP] | Japan | 9-84792 |
| Mar. 13, 1998 | [JP] | Japan | 10-63510 |
| Mar. 13, 1998 | [JP] | Japan | 10-63529 |

[51] Int. Cl.[7] ..... G03G 9/13

[52] U.S. Cl. ..... 430/114; 430/117; 399/237; 399/308

[58] Field of Search ..... 430/114, 115, 430/117, 119; 399/237, 308

[56] References Cited

U.S. PATENT DOCUMENTS

| | | | |
|---|---|---|---|
| 3,993,483 | 11/1976 | Maki et al. | 430/114 |
| 4,814,251 | 3/1989 | Igoe | 430/115 |
| 4,842,972 | 6/1989 | Tavernier et al. | 430/117 |
| 4,882,258 | 11/1989 | Ikeuchi et al. | 430/109 |
| 5,108,865 | 4/1992 | Zwaldo et al. | 430/117 |
| 5,156,937 | 10/1992 | Alexandrovich et al. | 430/110 |
| 5,407,771 | 4/1995 | Landa et al. | 430/109 |
| 5,759,733 | 6/1998 | Tsubuko et al. | 430/115 |
| 5,800,954 | 9/1998 | Kato et al. | 430/126 |

FOREIGN PATENT DOCUMENTS

| | | |
|---|---|---|
| 50-10140 | of 1975 | Japan . |
| 5-188659 | 7/1993 | Japan . |
| 7-92742 | 4/1995 | Japan . |
| 8-220813 | 8/1996 | Japan . |

OTHER PUBLICATIONS

Chemical Abstracts 120:311460 1993.

*Primary Examiner*—Christopher D. RoDee
*Attorney, Agent, or Firm*—Burns, Doane, Swecker & Mathis, LLP

[57] ABSTRACT

(1) Electrophotographic liquid developer comprising electrically insulating medium liquid and toner dispersed in the medium liquid, wherein the toner has a melt viscosity (η) in a range from $2\times10^2$ poises to $1\times10^5$ poises at 100° C. in a dry state, and has a glass transition temperature of 20° C. or more.

(2) Electrophotographic liquid developer comprising electrically insulating medium liquid and toner dispersed in the medium liquid, wherein the toner contains binder resin exhibiting at least one peak in each of ranges of a molecular weight lower than 5000 and of a molecular weight of 5000 or more when detected by a gel permeation chromatography (GPC).

(3) An image forming apparatus comprising an electrostatic latent image carrier for forming an electrostatic latent image; a liquid developing device developing the electrostatic latent image formed on the electrostatic latent image carrier into a visible toner image with liquid developer; an intermediate transfer member carrying the toner image transferred thereto from the electrostatic latent image carrier for further transferring the transferred toner image to a record member; and a heating device for heating the intermediate transfer member, wherein the liquid developing device develops the electrostatic latent image with the liquid developer of the above (1) or (2).

19 Claims, 1 Drawing Sheet

FIGURE
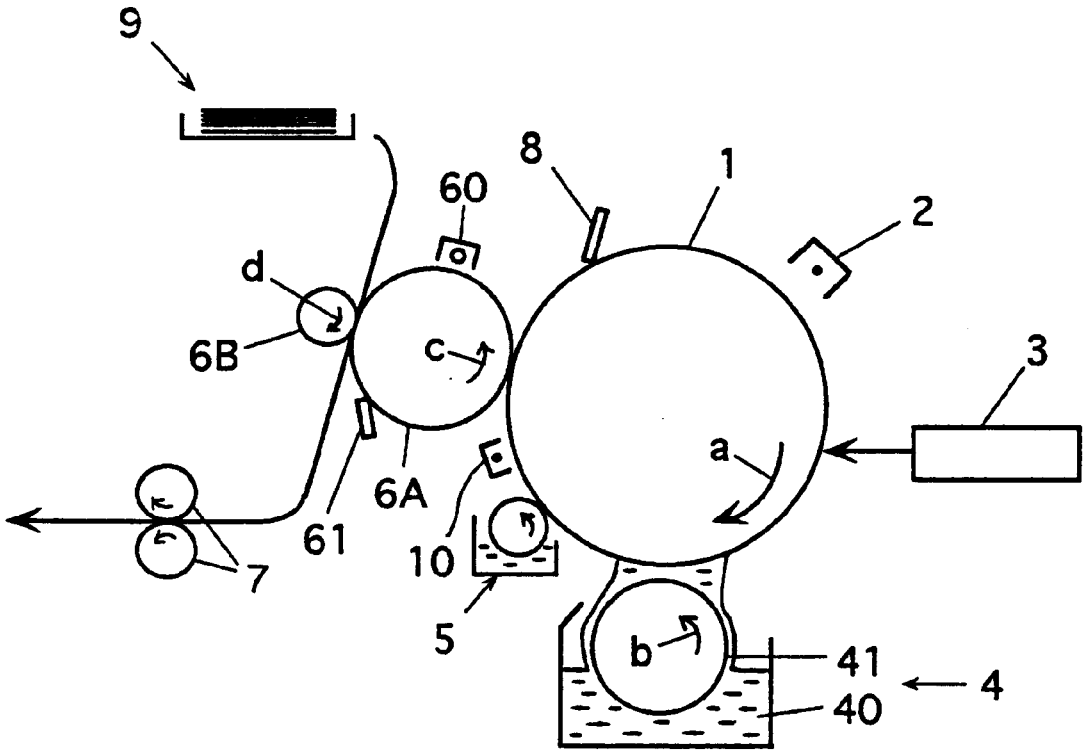

ELECTROPHOTOGRAPHIC LIQUID DEVELOPER AND IMAGE FORMING APPARATUS

This application is a divisional of application Ser. No. 09/053,697, filed Apr. 2, 1998 abandoned.

This application is based on application Nos. 9-84791 Pat., 9-84792 Pat., 10-63510 Pat., and 10-63529 Pat. filed in Japan, the contents of which are hereby incorporated by reference.

BACKGROUND OF THE INVENTION

1. Field of the Invention

The present invention relates to an electrophotographic liquid developer which is used for developing an electrostatic latent image in an image forming apparatus such as an electrophotographic copying machine, a printer or the like, and also relates to an image forming apparatus which uses liquid developer for developing the electrostatic latent image.

2. Description of the Background Art

Electrophotographic image formation is generally performed in such a manner that an electrostatic latent image is formed on an electrostatic latent image carrier such as a photosensitive member, for example, by image exposure corresponding to an original image or image data, and is developed into a visible toner image, which is transferred and fixed to a record member for obtaining an intended image.

The developing method can be classified into a dry developing method and a wet developing method.

In the dry developing method, developer which is formed of coloring particles (toner) or is formed of toner and carrier made of particles having magnetism or the like is used. The dry toner is usually formed of pigment and binder resin as major components, and also contains, if necessary, a charging control agent or material, a conductivity control agent, a plasticizer and a mold release material or the like internally or externally added to the major components. The magnetic toner further contains magnetic powder such as $Fe_3O_4$. Usually in the dry developing method, the toner is electrically charged by contact with a specific surface of the developing device or mutual contact of the toner particles. If the two-component developer containing carrier is used, the toner is charged by contact with the carrier or the like. Also, the toner is charged by electrostatic induction by an electric field, injection of electrons, ion absorption by discharging of ionized air and others. The toner thus charged is transported to an electrostatic latent image portion on an eltrostatic latent image carrier such as a photosensitive member by an electrostatic force, a mechanical force, a magnetic force or the like, and is developed with an electrostatic force.

Since the dry toner used in the dry development may escape into an atmosphere and may float in the air, it is impossible to employ the toner of an extremely small particle diameter. Usually, in the dry development toner having a relatively large average particle diameter of about 10 $\mu$m or less is used. Due to the relatively large toner particle diameter, the development with the dry toner can increase the resolution only to a limited extent.

Meanwhile, in the wet developing method the liquid developer is used. The liquid developer which is now mainstream and available is formed of a dispersing medium (carrier liquid) having an electrically insulating property as well as coloring particles (toner), which principally comprising pigment and binder resin, and a charging control material, a dispersion stabilizer and others. It has been considered that the toner is charged by absorption of ions owing to the charging control agent, and the charged toner is used for the development according to the principle of electrophoresis.

Since there is no possibility that the toner used in the wet development escapes into an atmosphere, the toner can be made of extremely fine particles, and the toner having an average particle diameter on the order of submicrons can be practically used. This can achieve an image having a high resolution, and can also achieve easy fixing of the toner image and other advantages.

According to the wet development, a toner image on the electrostatic latent image carrier, which is formed by developing an electrostatic latent image on the electrostatic latent image carrier with the liquid developer, is transferred and fixed to a record member in such a manner (1) that the toner image is directly transferred to the record member and then is fixed by a fixing device, (2) that the toner image is transferred and fixed directly to the record member by a simultaneous thermal-transfer/fixing manner or the like, (3) that the toner image is directly transferred to the record member by the simultaneous thermal-transfer/fixing manner or the like and further is finally fixed by the fixing device, (4) the toner image is transferred to an intermediate transfer member, and then the image is transferred to the record member and is fixed by the fixing device, (5) the image on the intermediate transfer member is transferred and fixed to the record member by the simultaneous thermal-transfer/fixing manner or the like, or (6) the image is transferred from the intermediate transfer member to the record member by the simultaneous thermal-transfer/fixing manner or the like, and further is finally fixed by the fixing device.

The intermediate transfer member is used, for example, in such a case that, for color image formation, multiple toner images of various colors such as cyan and magenta are formed on the intermediate transfer member, and then is collectively transferred to the record member, and in the following case. The electrostatic latent image carrier such as a photosensitive drum has a relatively hard and smooth surface. Meanwhile, the record member such as a paper sheet has a rough surface. If the toner image, which was formed with the liquid developer containing toner of about 1 $\mu$m–about 3 $\mu$m in average particle diameter, is electrostatically transferred directly onto the record member, a transfer efficiency may be low, and an image may be disturbed or destroyed. Therefore, thermal transfer can provide a better transfer property when the toner image is electrostatically transferred directly to the record member. In this case, simultaneous thermal-transfer/fixing may be performed with the intermediate transfer member which can perform better electrostatic transfer of the toner image from the electrostatic latent image carrier. In this simultaneous thermal-transfer/fixing, the toner image is first electrostatically transferred onto the intermediate transfer member, and then is thermally transferred onto a final transfer member such as a paper sheet.

However, in the structure where the liquid developer is used and the toner image formed on the electrostatic latent image carrier is directly transferred onto the record member, the electrostatic latent image carrier represented by a photosensitive member as well as other members is liable to be deteriorated due to an influence by heat. This disadvantage occurs regardless of whether the fixing device is employed in the final stage or not, if simultaneous thermal-transfer/fixing is employed, or if the image is temporarily carried on the intermediate transfer member and then is thermally transferred and fixed to the record member.

The following is an example employing the intermediate transfer member. Since the intermediate transfer member is always subject to a high temperature from about 140° C. to about 180° C., it is liable to be deteriorated, resulting in a short lifetime. Further, the photosensitive member neighboring to the intermediate transfer member has a low heat resistance. Therefore, the photosensitive member is liable to be deteriorated due to heating by the hot intermediate transfer member, resulting in a short lifetime. Since an organic photosensitive member which is generally used as the photosensitive member has a particularly low heat resistance, it remarkably suffers the above problem.

Even if the thermal transfer is not employed for the transfer of the toner image to the record member, an independent fixing device may be employed. This fixing device is usually arranged near the electrostatic latent image carrier such as a photosensitive member usually having a low heat resistance for a present demand for a compact structure of the image forming apparatus. Therefore, the electrostatic latent image carrier is liable to be deteriorated by the heat applied from this fixing device.

The thermal transfer (thermal transfer/fixing) and/or thermal fixing by the fixing device at a relatively low temperature may be performed for suppressing thermal damages and deterioration of parts in the image forming apparatus such as an electrostatic latent image carrier. For this, it is necessary that the toner of the toner image to be transferred and fixed to the record member melts at a relatively low temperature to allow thermal transfer and/or thermal fixing.

However, if the toner has such properties that the toner melts at an excessively low transfer and fixing temperatures is used, it also has a low glass transition temperature (Tg). Consequently, when a record member carrying the toner image transferred and fixed thereto is overlapped with another record member, the toner image on the record member on or under another record member may be partially transferred to a rear surface of the underlying or overlying record member, and thus an image rear-side transfer phenomenon occurs. Also, the upper and lower record members may adhere to each other, and thus blocking of the record members may occur. Further, blocking of toner particles may occur due to influences such as an atmospheric temperature during storage of the developer. Moreover, the toner which may melt at an excessively low transfer temperature is liable to cause a cleaning failure when cleaning the untransferred residual toner on the electrostatic latent image carrier and the intermediate transfer member.

For performing the thermal transfer and thermal fixing at a relatively low temperature and avoiding problems such as toner blocking, allowed thermal characteristics of the binder resin of the toner are restricted only to a narrow range. If only one kind of binder resin is used in the toner, predetermined thermal characteristics of the resin can be set by adjusting a composition of monomer, a molecular weight of the resin and others. However, production or synthesizing of the resin may be difficult depending on resin synthesizing conditions such as a composition of the monomer and a degree of polymerization. This reduces a range of selection of the binder resin.

SUMMARY OF THE INVENTION

An object of the invention is to provide an electrophotographic liquid developer used for developing an electrostatic latent image formed on an electrostatic latent image carrier into a visible toner image, and particularly liquid developer which allows thermal transfer and thermal fixing of the visible toner image onto a record member while suppressing thermal damages and deterioration of the electrostatic latent image carrier and other parts in an image forming apparatus.

Another object of the invention is to provide an electrophotographic liquid developer used for developing an electrostatic latent image formed on an electrostatic latent image carrier into a visible toner image, and particularly liquid developer which allows thermal transfer and thermal fixing of the visible toner image onto a record member while suppressing thermal damages and deterioration of the electrostatic latent image carrier and other parts in an image forming apparatus, and can avoid disadvantages such as blocking of toner particles and blocking of overlapped record members which carry transferred toner images.

Still another object of the invention is to provide above mentioned electrophotographic liquid developer, and particularly an electrophotographic liquid developer containing toner of which binder resin can be selected from a wide range for production.

Yet another object of the invention is to provide an image forming apparatus, in which liquid developer is used for developing an electrostatic latent image formed on an electrostatic latent image carrier into a visible toner image, and the visible toner image is transferred and fixed to the record member, and particularly an image forming apparatus which can thermally transfer and fix the visible toner image onto the record member while suppressing thermal damages and deterioration of the electrostatic latent image carrier and other parts.

Still further another object of the invention is to provide an image forming apparatus, in which liquid developer is used for developing an electrostatic latent image formed on an electrostatic latent image carrier into a visible toner image, and the visible toner image is transferred and fixed to the record member, and particularly an image forming apparatus which can thermally transfer and fix the visible toner image onto the record member while suppressing thermal damages and deterioration of the electrostatic latent image carrier and other parts, and can avoid disadvantages such as rear-side transfer of the image, i.e., transfer of the image from a record member to a rear side of another overlapped record member, blocking of overlapped record members and blocking of toner particles.

For achieving the above objects, after a series of researchs, the inventors have obtained the following knowledge.

For suppressing thermal damages and deterioration of parts in an image forming apparatus including an electrostatic latent image carrier such as an organic photosensitive member, thermal transfer (thermal transfer and fixing) and/or thermal fixing by a fixing device may be performed at a relatively low temperature which sets the temperature of the toner itself to be transferred and fixed to 100° C. or lower, and preferably 80° C. or lower. For performing the thermal transfer (thermal transfer and fixing) and/or thermal fixing by the fixing device, it is necessary that the toner of the toner image to be transferred and fixed to the record member attains a melted state allowing the thermal transfer and/or thermal fixing at a set temperature. Therefore, the melt viscosity of the toner at 100° C. is an important parameter which exhibits the melted state of the toner at 100° C. or lower, and the lower melt viscosity at 100° C. is more preferable.

However, an excessively low melt viscosity at 100° C. lowers the glass transition temperature, which tends to cause the rear-side transfer of the image, i.e., such a situation that the transferred and fixed toner image on one of the overlapped record members partially transfers to the rear surface of the other record member, blocking of record members, i.e., adhesion of the overlapped record members and blocking of toner particles, for example, due to an influence of atmospheric temperature during storage of the developer. Further, the toner which melts at an excessively low temperature is liable to cause a cleaning failure when cleaning untransferred residual toner on an electrostatic latent image carrier and/or an intermediate transfer member. Accordingly, the above problems can be avoided by setting the melt viscosity and the glass transition temperature of the toner in a predetermined range.

The good thermal transfer and/or good thermal fixing at a relatively low temperature which does not adversely affect the electrostatic latent image carrier and others can be performed, and problems such as rear-side transfer of the image of the record members, blocking of the record members and blocking of the toner can be avoided by employing such binder resin in toner that has a molecular weight of about 5000 obtained by a gel permeation chromatography (GPC). It is practically difficult to synthesize resin achieving a single peak at about 5000 when detected by analysis with GPC. However, by employing binder resin made of several kinds of resin having different molecular weights, a similar effect can be achieved.

The invention is based on the above findings, and provides the following kinds of electrophotographic liquid developer (1) and (2) as well as the following image forming apparatuses (a) and (b).

(1) The electrophotographic liquid developer including electrically insulating medium liquid (carrier liquid) and coloring particles (toner) dispersed in the medium liquid, wherein the toner has a melt viscosity (η) in a range from $2\times10^2$ poises to $1\times10^5$ poises at 100° C. in a dry state, and has a glass transition temperature of 20° C. or more.

(2) The electrophotographic liquid developer including electrically insulating medium liquid (carrier liquid) and coloring particles (toner) dispersed in the medium liquid, wherein the toner contains binder resin exhibiting at least one peak in each of ranges of a molecular weight lower than 5000 and of a molecular weight of 5000 or more when detected by a gel permeation chromatography (GPC).

(a) An image forming apparatus including an electrostatic latent image carrier for forming an electrostatic latent image; a liquid developing device developing the electrostatic latent image formed on the electrostatic latent image carrier into a visible toner image with liquid developer; and an intermediate transfer member carrying the toner image transferred thereto from the electrostatic latent image carrier for further transferring the transferred toner image to a record member, wherein the liquid developing device develops the electrostatic latent image with the liquid developer containing electrically insulating medium liquid and toner dispersed in the medium liquid and having a melt viscosity (η) in a range from $2\times10^2$ poises to $1\times10^5$ poises at 100° C. in a dry state and a glass transition temperature of 20° C. or more, the transfer of the toner image from the intermediate transfer member to the record member is performed by thermal transfer, and the intermediate transfer member is heated for the thermal transfer by a heating device.

(b) An image forming apparatus including an electrostatic latent image carrier for forming an electrostatic latent image; a liquid developing device developing the electrostatic latent image formed on the electrostatic latent image carrier into a visible toner image with liquid developer; and an intermediate transfer member carrying the toner image transferred thereto from the electrostatic latent image carrier for further transferring the transferred toner image to a record member, wherein the liquid developing device develops the electrostatic latent image with the liquid developer containing electrically insulating medium liquid and toner which is dispersed in the medium liquid and contains binder resin exhibiting at least one peak in each of ranges of a molecular weight lower than 5000 and of a molecular weight of 5000 or more when detected by a gel permeation chromatography (GPC), the transfer of the toner image from the intermediate transfer member to the record member is performed by thermal transfer, and the intermediate transfer member is heated for the thermal transfer by a heating device.

The foregoing and other objects, features, aspects and advantages of the present invention will become more apparent from the following detailed description when taken in conjunction with the accompanying drawings.

BRIEF DESCRIPTION OF THE DRAWINGS

The FIGURE shows a schematic structure of an example of an image forming apparatus according to the invention.

DESCRIPTION OF THE PREFERRED EMBODIMENTS

An electrophotographic liquid developer of a preferred embodiment of the invention includes toner, which has a melt viscosity (η) in a range from $2\times10^2$ poises to $1\times10^5$ poises at 100° C. in a dry state and has a glass transition temperature of 20° C. or more, and electrically insulating medium liquid (carrier liquid) in which the toner is dispersed.

The melt viscosity (η) is a viscosity which chain high polymer material exhibits in melted state, and can be measured, for example, by a high-load flow tester.

The glass transition temperature (Tg) is a temperature at which heated high polymer material changes from a glass-like hard state to a rubber-like state, and can be measured, for example, by a differential scanning calorimeter. When a single peak is detected by the differential scanning calorimeter, the glass transition temperature is represented by the temperature at which the single peak is detected. When multiple peaks are detected, the glass transition temperature is represented by the temperature at which the maximum peak is detected.

Since the electrophotographic liquid developer contains the toner having the melt viscosity of $1\times10^5$ poises or lower at 100° C. in the dry state, the toner of the toner image to be thermally transferred and/or thermally fixed to the record member can be melted to allow such processing, and transfer and fixing of the visible toner image to the record member can be performed at a temperature which can prevent thermal damages to the electrostatic latent image carrier, the intermediate transfer member and others so that the these members can have long lifetimes.

If the melt viscosity of the toner is excessively lowered in a conventional thermal transfer process, a high-temperature offset of the toner to the fixing heat roller occurs in the fixing device arranged downstream from the transfer region.

However, the embodiment can perform the transfer and fixing at a low temperature of 100° C. or lower, and therefore the dispersion medium (carrier liquid) in the liquid developer does not completely vaporize but remains as a mold release material at the nip region between the fixing heat roller and the record member so that the above high-temperature offset phenomenon is suppressed.

If the glass melt viscosity is low, the glass transition temperature is also low. According to the liquid developer of the preferred embodiment of the invention, the coloring particles (toner) have the melt viscosity ($\eta$) of $2\times10^2$ poises or higher at 100° C. in the dry state, and have the glass transition temperature of 20° C. or more. Under the normal use environment of the image forming apparatus such as a printer or a copying machine, it is therefore possible to suppress problems such as rear-side transfer of the image on the record member, blocking of the record members and blocking of the toner particles in the developer during storage. It is also possible to suppress a failure in cleaning untransferred residual toner on the electrostatic latent image carrier and/or the intermediate transfer member.

If the glass transition temperature of the toner is excessively high, the toner is liable to be deformed during the image formation and therefore it becomes difficult to obtain a stable image quality. Therefore, the desired glass transition temperature is about 75° C. or lower.

The thermal transfer and thermal fixing temperature which can prevent thermal damages to various parts in the image forming apparatus is about 100° C. or lower as already described. However, the temperature for the thermal transfer and thermal fixing, which can prevent thermal damages to various parts in the apparatus for a long term, is lower than about 80° C. Accordingly, in this liquid developer, the melt viscosity and the glass transition temperature of the toner in the liquid developer may be set to appropriate values within the foregoing ranges which allows thermal transfer and thermal fixing at the temperature lower than about 100° C. and more preferably lower than about 80° C.

According to another preferred embodiment of the invention, electrophotographic liquid developer includes toner containing binder resin which exhibits at least one peak in each of ranges of a molecular weight lower than 5000 and of a molecular weight of 5000 or more when detected by GPC, and electrically insulating medium liquid (carrier liquid) in which the toner is dispersed.

According to the electrophotographic liquid developer of this embodiment, the binder resin in the toner is made of a plurality of kinds of resin having different monomer compositions and/or polymerization degrees. Therefore, as compared with binder resin made of only a single kind of resin, the plurality of kinds of resin can be selected from a wide range to provide the binder resin having a predetermined melt viscosity and a predetermined glass transition temperature. This increases a range of resin design. Owing to this, it is possible to easily provide the liquid developer which can suppress thermal damages and deterioration of parts in the image forming apparatus, which may be caused by the thermal transfer and thermal fixing, and can avoid toner blocking and others.

The liquid developer employs the binder resin made of the plurality of kinds of resin and representing at least one peak in each of the ranges of the molecular weight lower than 5000 and of the molecular weight of 5000 or more when detected by GPC. This is because it is very difficult to synthesize resin having only a single peak at or about the molecular weight of 5000 detected by GPC. In particular, in the case of polyester resin which can be used as the binder resin of the toner in the liquid developer, if the polyester resin having the single peak at the molecular weight of about 5000 detected by GPC is to be synthesized, it is also easy to produce oligomer or the like of a very low polymerization degree. However, such oligomer or the like is easily soluble in the carrier liquid and thereby adversely affects the properties of the liquid developer. Accordingly, the binder resin is made of an appropriate mixture of the resin having a peak in a range of a high molecular weight of 5000 or more detected by GPC and resin having a peak in a lower range, whereby it is possible to suppress production of oligomer or the like of a very low polymerization degree and elution thereof into the carrier liquid.

The blocking is liable to occur if binder resin of dry toner is made of resin having the molecular weight of 5000 or less detected by GPC. In the liquid developer, however, the toner is dispersed in the carrier liquid so that the blocking as well as melting and mutual adhesion of toner particles are unlikely to occur although settlement of toner particles may occur. This is owing to the facts that the apparent specific gravity thereof in the carrier liquid is smaller than that in the air so that a pressure applied against the toner particles by its own weight is reduced, and that the carrier liquid itself effectively acts as a mold release material. Therefore, blocking of the toner particles can be suppressed even at the same temperature as the glass transition temperature or at higher temperature.

In this liquid developer, the molecular weights of the respective kinds of resin forming the binder resin of the toner detected by GPC as well as a mixture ratio thereof may be set to appropriate values which allows transfer and fixing at a temperature of about 100° C. or lower and more preferably lower than about 80° C.

For example, the following manner may be employed for producing the liquid developer including the toner, which has the melt viscosity ($\eta$) in a range from $2\times10^2$ poises to $1\times10^5$ poises at 100° C. in a dry state and has the glass transition temperature of 20° C. or more, and the electrically insulating medium liquid (carrier liquid) in which the toner is dispersed.

First, the binder resin and the coloring material are melted and mixed to disperse the coloring material into the resin.

The coloring material may be known pigment or dye such as carbon black or phthalocyanine. The addition ratio of the coloring material to the resin of 100 parts by weight is preferably in a range from about 5 parts by weight to about 20 parts by weight. The resin itself may be colored.

The binder resin of the toner particle may have a thermoplastic, and may also have such a property that the resin is substantially insoluble in the carrier liquid, although not restricted to this. For example, thermo-plastic saturated polyester resin, styrene-acrylic acid copolymer resin, styrene-acrylic acid modified polyester resin, polyolefine copolymer resin (particularly, ethylene-contained copolymer), epoxy resin, rosin modified phenol resin, rosin modified maleic acid resin or the like may be used solely or in a mixed form. If necessary, resin such as paraffin wax or polyolefine may be blended as a mold release agent at a ratio of 20% or less by weight.

Particularly, amorphous polyester resin is preferable because it is possible to change characteristics such as thermal characteristics of the amorphous polyester resin within a wide range, and further the amorphous polyester resin can provide a good light-transmittancy property and therefore a beautiful color in a color image. Also, it has good expansible properties and viscoelasticity, and therefore can provide a strong resin film after fixing. Accordingly, it can provide a good adhesion to the record medium such as a paper sheet.

More specifically, the polyester resin is resin produced by polycondensation of polyalcohol (polyhydric alcohol) and polyvalent basic acid (polyvalent carboxylic acid).

The polyalcohol may be alkylene glycol (aliphatic glycol) such as ethylene glycol, diethylene glycol, triethylene glycol, propylene glycol such as 1,2-propylene glycol, dipropylene glycol, butanediol such as 1,4-butanediol, neopentyl glycol, hexanediol such as 1,6-hexanediol, although not restricted thereto. Also, the polyalcohol may be made of the above material and alkylene oxide added thereto, or may be glycol which is derivative of phenol such as bisphenol (bisphenol A, hydrogen-added bisphenol or the like) and bisphenol including alkylene oxide added thereto, alicyclic or aromatic diol such as monocyclic or polycyclic diol or triol such as glycerol, trimethylolpropane, although not restricted thereto. The foregoing material may be used alone or together with one or more of the above materials.

Particularly, neopentyl glycol or bisphenol A to which alkylene oxide of 2 mols–3 mols is added is suitable as the binder resin for the toner of the liquid developer in view of the solubility and stability of the product, i.e., polyester resin, and is also preferable in view of a cost. The alkylene oxide may be ethylene oxide, propylene oxide or the like.

The polyvalent base acid (polyvalent carboxylic acid) may be saturated or unsaturated divalent basic acid such as malonic acid, succinic acid, adipic acid, azelaic acid, sebacic acid, fumaric acid, maleic acid, itaconic acid, phthalic acid and its modified acid (e.g., hexahydrophthalic anhydride), isophthalic acid or terephthalic acid, although not restricted thereto. Also, it may be tri- or higher-functional polyvalent basic acid such as trimellitic acid, pyromellitic acid or methyl nadic anhydride. Further, it may be anhydride of these acid, or lower alkyl ester. These may be used solely, or two or more kinds of them can be used in a mixed form.

Particularly, the isophthalic acid and terephthalic acid are suitable to the binder resin for the toner of the liquid developer in view of the solubility and stability of the product, i.e., polyester resin, and is also preferable in view of a cost.

The method of polycondensation may be a known method. The polycondensation is generally performed at a temperature from about 150° C. to about 300° C., depending on the kind of the material monomer. The conditions of polycondensation can be arbitrarily set, for example, by using an inert gas as an atmospheric gas, selectively using various solvents and/or setting a normal or reduced pressure in a reactor. For promoting the reaction, catalyzer for esterification may be used. The catalyzer for esterification may be a metal organic compound such as tetrabutyl zirconate, zirconium naphthenate, tetrabutyl titanate, tetraoctyl titanate, and 3/1 tin-oxalate/sodium-acetate. It is preferable that the catalyzer is made of a compound not coloring the product, i.e., ester. Alkyl phosphate, allyl phosphate or the like may be used as catalyzer or color control agent.

For example, by appropriately selecting the material described above, and/or by monitoring the acid value or the melt viscosity and thereby stopping the polymerization in an appropriate stage, it is possible to prepare the binder resin which is the material of the toner.

The kneaded coloring material which is made of the binder resin thus produced and, if necessary, the coloring agent and the charge adding agent are roughly crushed, e.g., by a cutter mill or a jet mill. A wet grinding is effected on the roughly crushed toner in a small amount of carrier liquid containing the charging control agent dissolved therein to obtain concentrated liquid developer. The concentrated liquid developer contains toner particles having a diameter in a range from about 0.5 $\mu$m to about 5 $\mu$m. The concentrated liquid developer thus obtained is diluted with and dispersed in the carrier liquid containing the charging control agent to attain an appropriate toner concentration.

The carrier liquid used in this embodiment has an appropriate electric resistance value in a range from about $10^{11}$ $\Omega$·cm to about $10^{16}$ $\Omega$·cm not disturbing the electrostatic latent image. The carrier liquid may keep any state at a normal temperature, and it is required only that the carrier liquid keep a liquid state when it is heated to a temperature of or above the softening point of the resin dispersed therein during the development. Further, it is preferable that it has a boiling point which allows rapid drying after the fixing. Also, it is preferable that the carrier liquid has neither odor nor virulence, and has a relatively high flash point.

For example, the carrier liquid may be made of aliphatic hydrocarbon, alicyclic hydrocarbon, aromatic hydrocarbon, hydrocarbon halogenide, polysiloxane or the like. In particular, normal paraffin solvent or isoparaffin solvent is preferable in view of odor, harmlessness and cost. More specifically, it may be Isopar G, Isopar H, Isopar L, Isopar K (all manufactured by Exon Kagaku Co., Ltd.), or Shellzole 71 (manufactured by Shell Sekiyu Kagaku Co., Ltd.), or may be IP solvent 1620 or IP solvent 2028 (both manufactured by Idemitsu Sekiyu Kagaku Co., Ltd.). Wax, paraffin or the like which is solid at a normal temperature may be used. The wax or paraffin which is solid at the normal temperature can be used in liquid state by heating before it is used as the liquid developer.

The rate of the toner with respect about to the carrier liquid is preferably in a range from about 0.5% to about 50% by weight, and more preferably in a range from about 2% to about 10% by weight in view of developing speed, image fogging and others. This rate or concentration is required during the development, and is not required during storage, supply, transportation and others.

The charging control agent is substantially solvated or dissolved in the carrier liquid, and is used for affecting the quantity of charges carried by the toner particles. More specifically, it may be a material selected from the following (1), (2) and (3), although not restricted thereto.

(1) Polymer or copolymer which includes as its component monomer containing nitrogen and is soluble in the carrier liquid. More specifically, such polymer is prepared that contains, as a component, (meth)acrylate having aliphatic amino group, nitrogen-containing heterocycle vinyl monomer, N-vinyl-substituted cyclic amide monomer, (meth)acrylamide, aromatic compound-substituted ethylene monomer having nitrogen-containing group, nitrogen-containing vinyl ether monomer or the like. The copolymer, which is soluble in the carrier liquid containing carbon hydride, is prepared by copolymerization of the above polymer with monomer of hexyl (meth)acrylate, cyclohexyl (meth)acrylate, 2-ethylhexyl (meth)acrylate, octyl (meth)acrylate, nonyl (meth)acrylate, decyl (meth) acrylate, dodecyl (meth)acrylate, lauryl (meth)acrylate, stearyl (meth)acrylate, vinyl laurate, vinyl stearate, benzyl (meth)acrylate, phenyl (meth)acrylate.

(2) Ionic surface active agent such as metal salt of aliphatic acid such as naphthenic acid, octenoic acid, oleic acid or stearic acid, metal salt of dialkyl sulfosuccinic acid, metal salt of alkyl sulfonic acid, calcium or barium salt of alkyl benzene sulfonic acid, metal salt of aromatic carboxylic acid or sulfonic acid, petroleum sulfonate (barium salt or calcium salt), basic petroleum sulfonate (barium salt or calcium salt), long-chain alkyl salicylate, long-chain alkylphosphonate, long-chain alkylphenate, basic phenate, metal salt of alkyl phosphoric acid ester, or metal salt of abietic acid or hydrogen-added abietic acid.

(3) Amphoteric surface active agent such as lecithin, or natural fat or oil such as linseed oil.

The charging control agents in the above groups (1), (2) or (3) may be used solely, or two or more kinds of them may be used in a mixed form.

In the group (1), random or graft copolymer of N-vinyl pyrrolidone or dimethylamino ethyl methacrylate with methacrylate ester having alkyl group from 10 to 20 in carbon number is preferably used. It is also preferable to use the copolymer containing nitrogen-containing monomer at a range from about 0.1% to about 30% by weight and, particularly, from about 0.5% to about 20% by weight. In the group (2), petroleum sulfonate (barium salt or calcium salt) or basic petroleum sulfonate (barium salt or calcium salt) is preferable. In the group (3), lecithin is preferable.

If necessary, a auxiliary dispersing agent may be additionally employed. The auxiliary dispersing agent may be polymer of acrylic monomer having long-chain alkyl group such as 2-ethylhexyl (meth)acrylate, lauryl (meth)acrylate or stearyl (meth)acrylate, or may be copolymer (random copolymer, graft copolymer, block copolymer or the like) of the above polymer and another monomer such as styrene, (meth)acrylic acid, methyl-, ethyl- or propyl-ester thereof. Alternatively, it may be rosin, rosin-modified resin or the like.

The charging control agent is preferably added to the carrier liquid at a rate from about 0.1% to about 5.0% by weight. Preferably, the rate thereof with respect to the toner is in a range from about 1.0% to about 80% by weight. More preferably, the rate is in a range from about 5% to about 70% by weight.

The electrophotographic liquid developer, in which the toner contains the binder resin exhibiting at least one peak in each of ranges of the molecular weight lower than 5000 and of the molecular weight of 5000 or more when detected by GPC, and is dispersed in the electrically insulating medium liquid (carrier liquid), can be manufactured similarly to the electrophotographic liquid developer of the embodiment already described. In this case, however, the binder resin is made of at least one kind of resin having the molecular weight lower than 5000 detected by GPC and at least one kind of resin having the molecular weight of 5000 or more detected by GPC.

The kinds of the coloring agent, binder resin, carrier liquid, charging control agent and auxiliary dispersing agent, rates of these materials, the manufacturing method of the binder resin, and the method of manufacturing the liquid developer from the binder resin and additives are the same as those for the electrophotographic liquid developer of the embodiment already described.

An image forming apparatus according to a preferred embodiment includes an electrostatic latent image carrier for forming an electrostatic latent image; a liquid developing device developing the electrostatic latent image formed on the electrostatic latent image carrier into a visible toner image with liquid developer; and an intermediate transfer member carrying the toner image transferred thereto from the electrostatic latent image carrier for further transferring the transferred toner image to a record member. The apparatus may include a fixing device for fixing the toner image transferred to the record member from the intermediate transfer member under a heat and a pressure. The liquid developing device develops the electrostatic latent image with the liquid developer containing electrically insulating carrier liquid and toner dispersed in the carrier liquid and having a melt viscosity ($\eta$) in a range from $2\times10^2$ poises to $1\times10^5$ poises at 100° C. in a dry state and a glass transition temperature of 20° C. or more. The transfer of the toner image from the intermediate transfer member to the record member is performed by the thermal transfer, and the intermediate transfer member is heated for the thermal transfer.

A heating device is employed for heating the intermediate transfer member. This heating device may be a thermal transfer device such as a thermal transfer roller for thermally transferring the toner image on the intermediate transfer member to the record member, and a preliminary heating device for preliminarily heating the toner image transferred onto the intermediate transfer member prior to the thermal transfer thereof to the record member.

According to this image forming apparatus, the development is performed with the liquid developer which contains the toner having the foregoing melt viscosity and the glass transition temperature. Therefore, the toner image on the intermediate transfer member can be thermally transferred (thermal transfer and fixing) to the record member and further, if necessary, thermally fixed thereto by the fixing device at a temperature in a range not causing thermal damages of the electrostatic latent image carrier, the intermediate transfer member and others so that these members can have long lifetimes. Also, it is possible to suppress hot offset of the toner to the fixing heat roller in the fixing device arranged downstream from the transfer region. Further, it is possible to suppress a failure in cleaning of the untransferred residual toner on the electrostatic latent image carrier and the intermediate transfer member. Under the normal use environment, it is possible to prevent problems such as rear-side transfer of the image on the record member, blocking of the record members and blocking of toner particles of the liquid developer in the developing device.

An image forming apparatus according to another preferred embodiment of the invention includes an electrostatic latent image carrier for forming an electrostatic latent image; a liquid developing device developing the electrostatic latent image formed on the electrostatic latent image carrier into a visible toner image with liquid developer; and an intermediate transfer member carrying the toner image transferred thereto from the electrostatic latent image carrier for further transferring the transferred toner image to a record member. The liquid developing device develops the electrostatic latent image with the liquid developer containing electrically insulating medium liquid and toner dispersed in the medium liquid and containing binder resin exhibiting at least one peak in each of ranges of a molecular weight lower than 5000 and of a molecular weight of 5000 or more when detected by a gel permeation chromatography (GPC). The transfer of the toner image from the intermediate transfer member to the record member is performed by the thermal transfer, and the intermediate transfer member is heated for the thermal transfer.

The image forming apparatus likewise employs a heating device for heating the intermediate transfer member. This heating device may be a thermal transfer device such as a thermal transfer roller for thermally transferring the toner image on the intermediate transfer member to the record member, and a preliminary heating device for preliminarily heating the toner image transferred on the intermediate transfer member prior to the thermal transfer thereof to the record member.

In this image forming apparatus, the liquid developing device develops the electrostatic latent image with the liquid developer containing the medium liquid and the toner dispersed in the medium liquid and containing the binder resin exhibiting at least one peak in each of ranges of the molecular weight lower than 5000 and of the molecular weight of 5000 or more when detected by GPC. Therefore, in this image forming apparatus, similarly in foregoing image forming aparatus, the toner image on the intermediate transfer member can be thermally transferred (thermal transfer and fixing) to the record member and further, if necessary, thermally fixed thereto by the fixing device at a temperature in a range not causing thermal damages of the electrostatic latent image carrier, the intermediate transfer member and others so that these members can have long lifetimes.

In any one of the image forming apparatuses of the foregoing embodiments, the intermediate transfer member is preferably heated to a temperature of about 100° C. or lower at a nip region with respect to the thermal transfer device such as a thermal transfer roller during transference. More preferably, it is heated to the temperature lower than about 80° C. If the thermal fixing device is employed, it attains the thermal fixing temperature in a similar range.

Any one of the foregoing image forming apparatuses may employ the liquid developing device, which is provided with a developer tank storing the liquid developer, and a developing roller opposed to the electrostatic latent image carrier with a minute space therebetween and has a portion located in the liquid developer. The intermediate transfer member may usually be adapted to carry temporarily the toner image transferred from the electrostatic latent image carrier by an electrostatic force and transfer subsequently the toner image by a heat (and a pressure) to the record member passed through a space between intermediate transfer member and, e.g., a thermal transfer roller.

The invention will be specifically described below with reference to specific embodiments. However, the invention is not restricted to the specific embodiments. In the following description of the specific embodiment, "parts" represent parts by weight, unless otherwise specified, "Mn" represents a number-average molecular weight, and "Mw" represents a weight-average molecular weight.

In the specific embodiments described below, the gel permeation chromatography (GPC) is performed with a fast liquid chromatograph pump TRI ROTAR-V type (manufactured by Nippon Bunkou Co., Ltd.), an ultraviolet spectrometer UVIDEC-100-V type (manufactured by Nippon Bunkou Co., Ltd.), and a 50 cm-long column Shodex GPC A-803 (Showa Denko Co., Ltd.). Mw is a polystyrene-conversion weight-average molecular weight, which is obtained by calculating the molecular weight of a specimen from the result of GPC based on the polystyrene as a reference substance. Mn is obtained from the result of GPC in a similar manner. The specimen is made of 0.05 g binder resin dissolved into 20 ml tetrahydrofuran (THF).

The glass transition temperature (Tg) is measured with a differential scanning calorimeter DSC-20 (manufactured by Seiko Denshi Kogyo Co., Ltd.) under the conditions that a weight of the specimen is 35 mg and a temperature rising rate is 10° C./min.

The melt viscosity (η) is measured with a high-load flow tester Flow Tester FT-500 (manufactured by Shimazu Seisakusho Co., Ltd.) under the following conditions:

Die: 1 mm (in diameter)×1 mm

Load: 30 kgf/cm$^2$

Preheating Time: 300 seconds

Factor: K=1.0

Specimen Weight: 1 g

Temperature: constant temperature measurement

An acid value is measure under the conditions of JIS K5400 rule.

A volume-average diameter ($d_{50}$) is measured with a laser diffraction particle-size distribution measuring device SALD-1100 (manufactured by Shimazu Seisakusho Co., Ltd.).

(A) Description will be given on examples of the electrophotographic liquid developer including electrically insulating medium liquid (carrier liquid) and coloring particles (toner) dispersed in the medium liquid, wherein the toner has the melt viscosity (η) in the range from $2\times10^2$ poises to $1\times10^5$ poises at 100° C. in a dry state, and has the glass transition temperature of 20° C. or more.

In the following liquid developer, polyester resin is used as the binder resin of the toner, and carbon black is used as the coloring agent. Description will now be given successively.

Production of Polyester Resin (1) Polyester Resin A1–A4 and A7

Bisphenol A (polyhydric alcohol) including propylene oxide added thereto of 2000 parts and isophthalic acid (polyvalent basic acid) of 930 parts were put into a round flask provided with a reflux condenser, a water-alcohol separator, a nitrogen gas supply pipe, a thermometer and a stirring device. A nitrogen gas was supplied thereinto while stirring the content, and thereby dehydro-polycondensation or dealcoholized polycondensation was performed at a temperature from 200° C. to 240° C. When the acid value of the produced polyester resin or the viscosity of the reaction solvent attained a predetermined value, the temperature of the reaction system was lowered to or below 100° C. to stop the polycondensation. In this manner, polyester resin A1–A4 and A7 were obtained.

(2) Polyester Resin A5, A6 and A8

Instead of the manner for producing the polyester resin A1–A4 and A7 by performing the reaction of the bisphenol A including propylene oxide added thereto of 2000 parts and isophthalic acid of 930 parts, the bisphenol A including ethylene oxide added thereto of 2000 parts and terephthalic acid of 920 parts were reacted with each other. Conditions other than the above were the same as those for producing the polyester resin A1–A4 and A7. In this manner, polyester resin A5, A6 and A8 were obtained.

Mn, Mw, Tg and acid values of the polyester resin A1–A8 thus obtained were measured. The results are shown in the following Table 1.

TABLE 1

| | Mn | Mw | Tg (° C.) | ACID VALUE (mg KOH/g) |
|---|---|---|---|---|
| A1 | 2700 | 4900 | 52.3 | 14.0 |
| A2 | 2200 | 4700 | 38.8 | 12.5 |
| A3 | 1500 | 4800 | 28.0 | 11.3 |
| A4 | 1200 | 2300 | 18.1 | 11.1 |
| A5 | 3480 | 7050 | 67.8 | 12.3 |
| A6 | 2850 | 6800 | 73.5 | 9.5 |
| A7 | 2580 | 4850 | 20.1 | 32.3 |
| A8 | 2950 | 8800 | 75.5 | 9.4 |

Manufacturing of Liquid Developer a1–a8

A mixture of the above polyester resin A1 of 60 g and a coloring agent made of carbon black Mogul L (manufactured by Cabot Co., Ltd.) was kneaded for four hours at 180° C. by a three-roll kneader to produce concentrated pigment kneaded product. This concentrated pigment kneaded product was diluted with the above polyester resin A1 by a kneader to produce finally a coloring resin kneaded product containing carbon black at 15% by weight. This coloring resin kneaded product was sufficiently cooled, and then was roughly crushed by a cutter mill. Further, it was finely crushed by a jet mill (manufactured by Nippon Pneumatic Kogyo Co., Ltd.) to produce colored toner rough particles having an average particle diameter of about 10 μm. This colored toner rough particles of 30 g were mixed with IP Solvent 1620 of 70 g containing petroleum sulfonate barium salt Sulfole Ba-30N (manufactured by Matsumura Sekiyu Kenkyusho Co., Ltd.) of 0.7% by weight dissolved therein. Using a sand grinder (manufactured by Igarashi Kikai Seizo Co., Ltd.) and, as a medium, glass beads of 150 cc having a diameter of 1 mm, wet grinding was effected on the above mixture for 15 hours in a ⅛ gallon Bessel, which was provided with a water jacket, under the condition of a cooling water temperature of 20° C. and a disk rotation speed of 2000 rpm. In this manner, concentrated liquid developer including the toner having a volume-average toner particle diameter of 1.45 μm was obtained.

The liquid developer a1 was obtained in such a manner that the above concentrated liquid developer of 100 parts was diluted with IP Solvent 1620 of 900 parts containing Sulfole Ba-30N of 0.7% by weight dissolved therein, and was subjected to dispersion processing for 10 minutes with Autohomo-Mixer M type (manufactured by Tokushu Kika Kogyo Co., Ltd.) rotating at 12000 rpm.

Liquid developer a2–a8 were produced in the same manner as that for the liquid developer a1 except for that polyester resin A2–A8 are used, respectively, instead of using the polyester resin A1 in the above manufacturing process.

Then, description will be given on evaluation which was performed on the liquid developer a1–a8, and more specifically glass transition temperatures of toner particles in a dry state, melt viscosities of dry toner particles at 100° C. and 120° C., thermal transferring and fixing properties, heat resistances, cleaning properties, stabilities of toner particle forms in image formation, and image qualities of the final images.

The glass transition temperature and the melt viscosity were evaluated in the manners already described.

Evaluation of the thermal transfer and fixing property was performed by actual tests using the image forming apparatus for the experiment, of which schematic structure is shown in the FIGURE, and the various kinds of liquid developer used therein. The thermal transfer and fixing properties were measured by measuring the lower limit of the temperature which allowed substantially complete (100%) thermal transfer and fixing with a system speed of 10 cm/sec.

The heat resistance was evaluated by determining whether blocking of the toner occurred or not after the liquid developer was stored at 55° C. for 8 hours.

The cleaning property was evaluated with the apparatus shown in the FIGURE by determining whether a toner cleaning failure occurred on the electrostatic latent image carrier (photosensitive drum) or not after 100 times of the image formation.

The form stability of toner particles in the image formation was evaluated with the apparatus shown in the FIGURE, and more specifically was evaluated by measuring a difference ($\Delta d_{50}$) between volume-average particle diameter of the toner in the developer before using and volume-average particle diameter of the toner in the developer which was collected by the cleaning device provided for the electrostatic latent image carrier (photosensitive drum).

The image quality of the final image was evaluated by determining whether image fogging occurred or not in initial image which was initially produced by the apparatus shown in the FIGURE.

An image forming apparatus for the experiment shown in the FIGURE is an electrophotographic type, and is provided with a photosensitive drum 1. The apparatus also includes a charger 2, an image exposing device 3 using a laser beam, a liquid developing device 4, a squeeze roller 5, a squeeze charger 10, an intermediate transfer roller 6A and a cleaning device 8 which are arranged in this order around the photosensitive drum 1. The developing device 4 includes a developer tank 40 storing the liquid developer, and a developing roller 41 opposed to the photosensitive drum 1 with a minute space therebetween and has a lower portion located in the liquid developer. A thermal transfer roller, i.e., heat rubber roller (heating roller) 6B is opposed to the transfer roller 6A with the photosensitive drum 1 therebetween. A lamp heater 60 faces the intermediate transfer roller 6A in a region between the nip with respect to the photosensitive member 1 and the nip with respect to the roller 6B. A cleaning device 61 faces the intermediate transfer roller 6A downstream from the roller 6B. A sheet supply device 9 and a thermal fixing roller pair 7 are arranged at the vicinity of the intermediate transfer roller 6A and the heat rubber roller 6B. Although the thermal fixing roller pair 7 is spaced from the photosensitive drum 1 in the FIGURE, it is in close proximity to the photosensitive drum 1 in the actual image forming apparatus for compacting.

In the image forming operation, the photosensitive drum 1 is rotated in the direction indicated by an arrow a in the FIGURE. The developing roller 41 and the intermediate transfer roller 6A rotate in the directions (indicated by arrows b and c in the FIGURE) opposite to the rotating direction of the photosensitive drum 1, and the heat rubber roller 6B rotates in the direction (indicated by an arrow d in the FIGURE) opposite to the intermediate transfer roller 6A.

In the actual operation test of this image forming apparatus, the surface of the photosensitive drum 1 is first charged uniformly by the charger 2 to a potential of about −1000 V. The electrostatic latent image is formed on the surface of the photosensitive drum 1 by the laser beam emitted from the image exposing device 3 to the photosensitive drum 1 based on the image information. The electrostatic latent image formed on the photosensitive drum 1 is visualized by the liquid developing device 4 with the liquid developer.

Thereafter, extra liquid developer adhering to the photosensitive drum 1 is squeezed and removed by the squeeze roller device 5 which is driven to rotate and the squeeze charger 10 so that the toner image containing only a small amount of liquid is formed on the surface of the photosensitive drum 1. The toner image is moved to the transfer position opposed to the intermediate transfer roller 6A, and is transferred onto the surface of the roller 6A by electrostatic transference. The intermediate transfer roller 6A is supplied with a transfer voltage of +1000 V from a power source (not shown). The toner image on the roller 6A further moves to the transfer position opposed to the heat rubber roller 6B, during which it is preliminarily heated by the lamp heater 60. At the transfer position, the toner image comes into contact with the paper sheet transported from the sheet supply device 9, and the toner image is thermally transferred and fixed to the sheet simultaneously. The temperatures of the intermediate transfer roller 6A and the heat rubber roller 6B are set to the same temperatures at nips therebetween. The transferred sheet is transported to the thermal fixing roller pair 7, which finally fixes the image by heat and pressure to complete one image. Then, the sheet is discharged to a discharge tray (not shown). The liquid developer remaining on the surface of the photosensitive drum 1 is removed by the cleaning device 8, and the residual developer on the intermediate transfer roller 6A is removed by the cleaning device 61 for the next image formation.

The following table 2 represents results of evaluation of the glass transition temperatures of the toner particles in a dry state, the melt viscosities of the toner particles in a dry state at 100° C. and 120° C., the thermal transfer/thermal fixing properties (lower limits of the temperature allowing the thermal transfer and thermal fixing), the heat resistances (occurrence/non-occurrence of the toner blocking), the cleaning properties (occurrence/non-occurrence of cleaning failure), the form stabilities of the toner (variations in volume-average particle diameter of the toner caused by image formation) and the qualities of the initial images (occurrence/non-occurrence of the image fogging). In the column of image evaluation of the table 2, "O" represents non-occurrence of the image fogging, and "X" represents occurrence of the image fogging.

TABLE 2

| | Tg (° C.) | M/V (poises) | L/Tmp (° C.) | BL | C/F | V/T (μm) | I/E |
|---|---|---|---|---|---|---|---|
| a1 | 52.3 | $4.34 \times 10^4/1.20 \times 10^3$ | 98 | N | N | 0 | O |
| a2 | 38.8 | $3.45 \times 10^3/7.56 \times 10^2$ | 85 | N | N | 0 | O |
| a3 | 28.0 | $1.22 \times 10^3/1.58 \times 10^2$ | 72 | N | N | 0 | O |
| a4 | 18.1 | $2.1 \times 10^2/1.22 \times 10^2$ | 69 | Y | N | 0 | X |
| a5 | 67.8 | $3.2 \times 10^5/2.10 \times 10^3$ | 122 | N | N | 0 | X |
| a6 | 73.5 | $3.5 \times 10^6/7.20 \times 10^3$ | 140 | N | N | 0 | X |
| a7 | 20.1 | $1.9 \times 10^2/1.21 \times 10^2$ | 65 | N | Y | 0 | X |
| a8 | 75.5 | $1.2 \times 10^5/1.91 \times 10^3$ | 115 | N | N | 0.2 | X |

M/V: melt viscosity (100° C./120° C.)
L/Tmp: lower limit of temperature allowing thermal transfer and thermal fixing
BL: occurrence/non-occurrent of the toner blocking
C/F: occurrence/non-occurrence of cleaning failure
V/T: variation in toner particle diameter ($\Delta d_{50}$)
I/E: image evaluation
Y: occurred
N: not occurred According to the above result, the thermal transfer and thermal fixing could be performed substantially completely (100%) at the temperature of 100° C. or lower when the image formation was performed with the liquid developer a1–a4 and a7 containing the toner particles which had the melt viscosity (η) of $1\times10^5$ poises or lower at 100° C. in a dry state. With the liquid developer a5, a6 and a8 containing the toner which had the melt viscosity larger than $1\times10^5$ poises, the thermal transfer and thermal fixing could not be completely (100%) performed at the temperature of 100° C. or lower. With the liquid developer a7 having the toner melt viscosity smaller than $2\times10^2$ poises, the substantially complete (100%) thermal transfer and thermal fixing could be performed at 100° C. or lower, but failure in cleaning the photosensitive drum occurred.

With the liquid developer a1–a3 and a5–a8 exhibiting the glass transition temperature of 20° C. or more, toner blocking was not found even after storage at a high temperature of 55° C. for 8 hours. However, with the liquid developer a4 exhibiting the glass transition temperature lower than 20° C., the toner blocking was found. With the liquid developer a8 exhibiting the glass transition temperature higher than 75° C., the image formation caused a variation in volume-average particle diameter of the toner. As described above, the substantially complete (100%) thermal transfer and thermal fixing could be performed at the temperature of 100° C. or lower in the initial image formation with the liquid developer a1–a3 containing the toner particles, which exhibited the melt viscosity from $2\times10^2$ poises to $1\times10^5$ poises at 100° C. in a dry state as well as the glass transition temperature between 20° C. and 75° C. It can be understood that the developer a1–a3 allow thermal transfer and thermal fixing of the image to the record member while suppressing thermal damages of the photosensitive member and others. If the thermal fixing temperature higher than 100° C. is required in initial image formation, this high temperature deteriorates the photosensitive member, and thus causes image fogging.

With the liquid developer a1–a3, image fogging was not found and good images could be obtained. Probably, this is owing to the facts that a thermal influence on the photosensitive drum and others is suppressed because the thermal transfer and thermal fixing is allowed at the temperature of 100° C. or lower, that occurrence of the toner blocking is suppressed, that occurrence of the cleaning failure is suppressed and that the toner has high form stability. It can be understood that the liquid developer a1–a3 can provide stable image qualities for a long term.

In connection with the parameters exhibiting the thermal transfer property, it can be understood from the table 2 that the melt viscosity at 100° C. is more sensitive than the melt viscosity at 120° C., and causes a larger difference in value so that it is more preferable to specify the melt viscosity at 100° C.

(B) Description will be given on examples of the electrophotographic liquid developer including the electrically insulating medium liquid (carrier liquid) and the toner dispersed in the medium liquid, wherein the toner contains binder resin exhibiting at least one peak in each of ranges of the molecular weight lower than 5000 and of the molecular weight of 5000 or more when detected by the GPC.

In the following liquid developer, polyester resin is used as the binder resin of the toner, and carbon black is used as the coloring agent. Description will now be given successively.

Production of Polyester Resin (1) Polyester Resin B1, B5 and B6

Bisphenol A (polyhydric alcohol) including ethylene oxide added thereto of 2000 parts and terephthalic acid (polyvalent basic acid) of 920 parts were put into a round flask provided with a reflux condenser, a water-alcohol separator, a nitrogen gas supply pipe, a thermometer and a stirring device. A nitrogen gas was supplied thereinto while stirring the content, and thereby dehydro-polycondensation or dealcoholized polycondensation was performed at a temperature from 200° C. to 240° C. When the acid value of the produced polyester resin or the viscosity of the reaction solvent attained a predetermined value, the temperature of the reaction system was lowered to or below 100° C. to stop the polycondensation. In this manner, polyester resin B1, B5 and B6 were obtained.

(2) Polyester Resin B2–B4

Instead of the manner for producing the polyester resin B1, B5 and B6 by performing the reaction of the bisphenol A including ethylene oxide added thereto of 2000 parts and terephthalic acid of 920 parts, the bisphenol A including propylene oxide added thereto of 2000 parts and isophthalic acid of 930 parts were reacted with each other. Conditions other than the above were the same as those for producing the polyester resin B1, B5 and B6. In this manner, polyester resin B2–B4 were obtained.

Mn, Mw, Tg and acid values of the polyester resin B1–B6 thus obtained were measured. The results are shown in the following Table 3.

TABLE 3

| | Mn | Mw | Tg (° C.) | ACID VALUE (mg KOH/g) |
|---|---|---|---|---|
| B1 | 3480 | 7750 | 67.8 | 12.3 |
| B2 | 2150 | 4650 | 33.8 | 12.5 |
| B3 | 1200 | 2300 | 18.1 | 11.1 |
| B4 | 850 | 1600 | 5.2 | 9.5 |
| B5 | 3420 | 6050 | 35.0 | 13.0 |
| B6 | 3500 | 6800 | 58.0 | 12.5 |

Manufacturing of Liquid Developer

Blend resin (A) was prepared by sufficiently mixing the above polyester resin B1 of 40 parts and the above polyester resin B4 of 60 parts at 120° C. A mixture of the blend resin (A) of 60 g and a coloring agent made of carbon black Mogul L (manufactured by Cabot Co., Ltd.) was kneaded for four hours at 180° C. by a three-roll kneader to produce concentrated pigment kneaded product. This concentrated pigment kneaded product was diluted with the above blend resin (A) by a kneader to produce finally a coloring resin kneaded product containing carbon black at 15% by weight. This coloring resin kneaded product was sufficiently cooled, and then was roughly crushed by a cutter mill. Further, it was finely crushed by a jet mill (manufactured by Nippon Pneumatic Kogyo Co., Ltd.) to produce colored toner rough particles having an average particle diameter of about 10 μm. This colored toner rough particles of 30 g were mixed with IP Solvent 1620 of 70 g containing petroleum sulfonate barium salt Sulfole Ba-30N (manufactured by Matsumura Sekiyu Kenkyusho Co., Ltd.) of 0.7% by weight dissolved therein. Using a sand grinder (manufactured by Igarashi Kikai Seizo Co., Ltd.) and, as a medium, glass beads of 150 cc having a diameter of 1 mm, wet grinding was effected on the above mixture for 15 hours in a ⅛ gallon Bessel, which was provided with a water jacket, under the condition of a cooling water temperature of 20° C. and a disk rotation speed of 2000 rpm. In this manner, concentrated liquid developer including the toner having a volume-average toner particle diameter of 1.45 μm was obtained.

Further, liquid developer b1 was obtained in such a manner that the above concentrated liquid developer of 100 parts was diluted by IP Solvent 1620 of 900 parts containing Sulfole Ba-30N at 0.7% by weight dissolved therein, and dispersion processing was performed on the same for 10 minutes with Autohomo mixer (manufactured by Tokushu Kika Kogyo Co., Ltd.) rotating at 12000 rpm.

Liquid developer b2 was produced in the same manner as that for the liquid developer b1 except for that only the polyester resin B2 was used as the binder resin, instead of using the polyester resin B1 of 40 parts and the polyester resin B4 of 60 parts in the above manufacturing process. The other conditions were the same as those for manufacturing the liquid developer b1.

Liquid developer b3 was produced in the same manner as that for the liquid developer b1 except for that only the polyester resin B3 was used as the binder resin, instead of using the polyester resin B1 of 40 parts and the polyester resin B4 of 60 parts in the above manufacturing process. The other conditions were the same as those for manufacturing the liquid developer b1.

Liquid developer b4 was produced in the same manner as that for the liquid developer b1 except for that only the polyester resin B1 was used as the binder resin, instead of using the polyester resin B1 of 40 parts and the polyester resin B4 of 60 parts in the above manufacturing process. The other conditions were the same as those for manufacturing the liquid developer b1.

Liquid developer b5 was produced in the same manner as that for the liquid developer b1 except for that the polyester resin B1 of 50 parts and the polyester resin B5 of 50 parts were used as the binder resin, instead of using the polyester resin B1 of 40 parts and the polyester resin B4 of 60 parts in the above manufacturing process. The other conditions were the same as those for manufacturing the liquid developer b1.

Liquid developer b6 was produced in the same manner as that for the liquid developer b1 except for that the polyester resin B1 of 50 parts and the polyester resin B6 of 50 parts were used as the binder resin, instead of using the polyester resin B1 of 40 parts and the polyester resin B4 of 60 parts in the above manufacturing process. The other conditions were the same as those for manufacturing the liquid developer b1.

Liquid developer b7 was produced in the same manner as that for the liquid developer b1 except for that the polyester resin B5 of 50 parts and the polyester resin B3 of 50 parts were used as the binder resin, instead of using the polyester resin B1 of 40 parts and the polyester resin B4 of 60 parts in the above manufacturing process. The other conditions were the same as those for manufacturing the liquid developer b1.

Then, description will be given on evaluation which was performed on the liquid developer b1–b8, and more specifically molecular weights (peak positions) detected by GPC, melt viscosities of dry toner particles at 100° C., thermal transferring and thermal fixing properties, heat resistances and image qualities of the final images after image formings on many sheets.

The thermal transferring and thermal fixing properties were evaluated in the same manner as that for the foregoing liquid developer a1–a8. Measurement of the melt viscosities and measurement of the molecular weights by GPC were performed in the manners already described. The image qualities of the final images were evaluated by determining occurrence and non-occurrence of the image fogging of the image produced after image formation on 100,000 sheets.

The following table 4 represents results of evaluation of the molecular weights detected by GPC, the melt viscosities of the toner particles in a dry state at 100° C., the thermal transfer/thermal fixing properties (lower limit of the temperatures allowing the thermal transfer and thermal fixing), the heat resistance (occurrence/non-occurrence of the toner blocking) and the quality of the final images (occurrence/non-occurrence of the image fogging) after many image formations. In the column of image evaluation of the table 4, "O" represents non-occurrence of the image fogging, "X" represents occurrence of the image fogging, and "XX" represents remarkable occurrence of the image fogging.

TABLE 4

| | GPC/P (M) | M/V (poises) | L/Tmp (° C.) | BL | I/E |
|---|---|---|---|---|---|
| b1 | 6731/1350 | $3.34 \times 10^2$ | 71 | N | O |
| b2 | 3870 | $9.45 \times 10^2$ | 80 | N | X |
| b3 | 1950 | $2.1 \times 10^2$ | 69 | Y | XX |
| b4 | 6731 | $5.3 \times 10^3$ | 90 | N | X |
| b5 | 6731/4920 | $3.55 \times 10^2$ | 73 | N | O |

TABLE 4-continued

| | GPC/P (M) | M/V (poises) | L/Tmp (° C.) | BL | I/E |
|---|---|---|---|---|---|
| b6 | 6731/5100 | $3.50 \times 10^2$ | 72 | Y | XX |
| b7 | 4920/1950 | $2.50 \times 10^2$ | 70 | Y | XX |

GPC: GPC peak
M/V: melt viscosity (100° C.)
L/Tmp: lower limit of temperature allowing thermal transfer and thermal fixing
BL: occurrence/non-occurrence of blocking
I/E: image evaluation
Y: occurred
N: not occurred According to the above results, the liquid developer b1 and b5 each including the toner in which the binder resin exhibits one peak in each of ranges lower and higher than the molecular weight of 5000 detected by GPC could provide good images without image fogging even after printing of 100,000 sheets. The following can be considered as the reason of this. Since the properties including the melt viscosity and the glass transition temperature of the binder resin were set to appropriate values owing to employment of the two kinds of resin exhibiting the molecular weight lower than 5000 and the molecular weight of 5000 or more detected by GPC, respectively, substantially complete (100%) thermal transfer and thermal fixing could be performed at a low temperature lower than 80° C., and occurrence of the toner blocking was suppressed.

Image fogging was found after image formation on 100,000 sheets when image formation was performed with the liquid developer b3 including the toner in which the binder resin exhibits a single peak only in a range of the molecular weight lower than 5000 detected by GPC, the liquid developer b6 including the toner in which the binder resin was made of a mixture of two kinds of resin each exhibiting a peak only in a range of the molecular weight of 5000 or higher detected by GPC, and the liquid developer b7 including the toner in which the binder resin was made of a mixture of two kinds of resin each exhibiting a peak only in a range of the molecular weight lower than 5000 detected by GPC. It can be considered that this is due to occurrence of the toner blocking.

Image fogging was also found on the final images after image formation on 100,000 sheets when image formation was performed with the liquid developer b2 including the toner in which the binder resin exhibits a single peak only in a range of the molecular weight lower than 5000 detected by GPC, and the liquid developer b4 including the toner in which the binder resin exhibits a single peak only in a range of the molecular weight of 5000 or more detected by GPC. It can be considered that the above image fogging is due to that fact that the temperatures allowing the substantially complete (100%) transfer and fixing with the liquid developer b2 and b4 were 80° C. and 90° C., respectively, and therefore were relatively high so that these high temperatures deteriorated the photosensitive drum 1. It can be considered that for obtaining good images without image fogging after processing of many sheets, it is necessary to perform the thermal transfer and thermal fixing at a temperature lower than 80° C. for avoiding deterioration of the electrostatic latent image carrier (photosensitive drum) or the like by the heat.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A liquid developer comprising:

carrier liquid; and toner being dispersed in the carrier liquid and comprising a binder resin and a coloring agent, the binder resin having at least one peak in each range of molecular weight comprising a molecular weight lower than 5000 and a molecular weight of 5000 or more when detected by a gel permeation chromatography.

2. The liquid developer according to claim 1, wherein the coloring agent is in an amount of from 5 to 20 parts by weight with respect to 100 parts by weight of the binder resin.

3. The liquid developer according to claim 1, wherein the carrier liquid has a electric resistance value in a range of from $10^{11}$ to $10^{16}$ Ω·cm.

4. The liquid developer according to claim 1, wherein the toner is present in an amount of from 0.5 to 50% by weight with respect to the carrier liquid.

5. The liquid developer according to claim 4, wherein the toner is present in an amount of from 2 to 10% by weight with respect to the carrier liquid.

6. The liquid developer according to claim 1, wherein the carrier liquid contains a charge control agent in an amount of from 0.1 to 5% by weight with respect to the carrier liquid.

7. The liquid developer according to claim 1, wherein the toner contains a charge control agent in an amount of from 1 to 80% by weight with respect to the toner.

8. The liquid developer according to claim 1, wherein the toner has a volume-average particle diameter of from 0.5 to 5 μm.

9. The liquid developer according to claim 1, wherein the toner has a thermal transfer temperature of lower than 80° C.

10. The liquid developer according to claim 1, wherein the toner has a melt viscosity of from $2\times10^2$ to $1\times10^5$ poises at 100° C.

11. The liquid developer according to claim 1, wherein the binder resin includes a first binder resin and a second binder resin, the first binder resin having one peak in the range of molecular weight lower than 5000, and the second binder resin having one peak in the range of molecular weight of 5000 or more.

12. An image forming apparatus comprising:

an image carrier for supporting an electrostatic latent image;

a liquid developing device for accommodating a liquid developer and developing the latent image into a visible toner image with the liquid developer, the liquid developer comprising carrier liquid and toner including a binder resin and a coloring agent, the binder resin having at least one peak in each range of molecular weight comprising a molecular weight lower than 5000 and a molecular weight of 5000 or more when detected by a gel permeation chromatography;

an intermediate transfer member for supporting the toner image transferred from the image carrier; and a transferring member for transferring the toner image from the intermediate transfer member to a recording member.

13. The image forming apparatus according to claim 12, wherein the transferring member is a headted roller having a temperature lower than 80° C.

14. The image forming apparatus according to claim 12, wherein the carrier liquid has an electric resistance value in a range of from $10^{11}$ to $10^{16}$ Ω·cm.

15. The image forming apparatus according to claim 12, wherein the toner is present in an amount of from 0.5 to 50% by weight with respect to the carrier liquid.

16. The image forming apparatus according to claim 12, wherein the toner has a volume-average particle diameter of from 0.5 to 5 $\mu$m.

17. The image forming apparatus according to claim 12, wherein the toner has a melt viscosity of from $2\times10^2$ to $1\times10^5$ poises at 100° C.

18. The image forming apparatus according to claim 12, wherein the binder resin includes a first binder resin and a second binder resin, the first binder resin having one peak in the range of molecular weight lower than 5000, and the second binder resin having one peak in the range of molecular weight of 5000 or more.

19. An image forming method comprising:

forming an electrostatic latent image on an image carrier;

developing the latent image into a visible toner image with a liquid developer, the liquid developer comprising carrier liquid and toner including a binder resin and a coloring agent, the binder resin having at least one peak in each range of molecular weight comprising a molecular weight lower than 5000 and a molecular weight of 5000 or more when detected by a gel permeation chromatography;

transferring the toner image from the image carrier to an intermediate transfer member; and thermally transferring the toner image from the intermediate transfer member to a recording member.

* * * * *